United States Patent [19]

Samejima et al.

[11] Patent Number: 4,972,772

[45] Date of Patent: Nov. 27, 1990

[54] THERMAL TRANSFER MACHINE FOR BELT MARKINGS

[75] Inventors: Hisashi Samejima; Kenji Kido; Masahiro Oka, all of Kobe, Japan

[73] Assignee: Bando Kagaku Kabushiki Kaisha, Kobe, Japan

[21] Appl. No.: 463,307

[22] Filed: Jan. 10, 1990

[30] Foreign Application Priority Data

Jan. 12, 1989 [JP] Japan ..... 1-2528[U]

[51] Int. Cl.[5] ..... B41F 17/00

[52] U.S. Cl. ..... 101/37; 156/582

[58] Field of Search ..... 101/36, 37; 400/584, 400/600, 605, 622, 623, 642, 645, 645.3, 645.4, 679; 219/216; 428/913, 914; 156/230, 582, 583, 540, 541

[56] References Cited

U.S. PATENT DOCUMENTS

| | | | |
|---|---|---|---|
| 1,128,753 | 2/1915 | Buckley | 101/37 |
| 1,176,449 | 3/1916 | Hollick et al. | 101/37 |
| 3,083,757 | 4/1963 | Kraft et al. | 156/582 |
| 3,492,182 | 1/1970 | Howard | 156/582 |
| 3,531,361 | 9/1970 | Grandinetti | 156/582 |
| 4,448,558 | 5/1984 | Weingarten | 400/622 |

*Primary Examiner*—Edgar S. Burr
*Assistant Examiner*—C. A. Bennett
*Attorney, Agent, or Firm*—Marshall, O'Toole, Gerstein, Murray & Bicknell

[57] ABSTRACT

A thermal transfer machine comprising a freely rotatable belt attachment roller onto which an endless belt can be removably attached with the surface to be imprinted facing outwardly, a freely rotatable thermal roller placed so as to be movable toward and away from said belt attachment roller, a pair of support arms placed parallel to each other across an open space so that said thermal roller is positioned between them, and a marking paper support which has securing fixtures for stretching the marking paper across the space between the support arms and which is capable of moving in a reciprocating motion in the front-to-back direction of the thermal roller. With said thermal roller pressed against the belt on said belt attachment roller by a pressing apparatus, the marking paper support is moved at the same speed as the peripheral velocity of the thermal roller in the direction of the tangent of the thermal roller occurring at the contact surface between the thermal roller and the belt by the drive apparatus which turns the thermal roller.

2 Claims, 4 Drawing Sheets

THERMAL TRANSFER MACHINE FOR BELT MARKINGS

FIELD AND BACKGROUND OF THE INVENTION

This invention relates to a machine which uses thermal transfer marking paper for the thermal transfer of the manufacturer's name, serial number, date of manufacture, belt size, and other indicia onto an endless belt or onto a tube-shaped belt material (hereafter also referred to simply as an endless belt) prior to its being cut into specified widths.

The thermal transfer of indicia, such as those described above, onto an endless belt is accomplished using marking paper which has been printed so as to make thermal transfer possible. Because there are many different belt indicia, it is common to use multiple sheets of different varieties of marking paper. For wide belts, the thermal transfer is made onto the belt itself, and for narrow belts, it is made onto tube-shaped belt material prior to its being cut into specified widths. For this reason, in order to perform thermal transfer onto belt material, the size of the characters to be indicated must be considerably smaller than the width of the endless belt which will be the final product, and repeated lines of the same indicia must be transferred so that at least one line of the complete indicia is transferred onto each endless belt after cutting.

Until now, machines having a construction such as that described below have been used as thermal transfer devices for the transfer of indicia such as those mentioned above. As shown in FIG. 6, after an endless belt A is positioned with the surface to be imprinted facing outwardly on a freely revolving belt attachment roller 2', the belt A on the belt attachment roller 2' is squeezed by a thermal roller 6' and compressed at a fixed pressure P, and then the thermal roller 6' revolves at a fixed slow speed in order to slowly revolve the belt A. Then, a marking paper B is inserted and passed through the nip formed between the contact surfaces of the thermal roller 6' and the belt A, and the indicia printed on the marking paper B is thermally transferred onto the surface of the belt.

With the thermal transfer machines of the prior art described above, the operator had to manually insert the marking paper between the contact surfaces of the thermal roller and the belt, and, because it is common for multiple sheets of marking paper to be used, the operator had to remain close to the thermal transfer device until the completion of the thermal transfer operation. Thus, during that time, the operator was not able to perform other tasks, such as the preparation of the marking paper for transfer to the next belt, and work efficiency was extremely poor. Moreover, because the marking paper was inserted by hand while the thermal roller and the belt were revolving, the marking paper could easily become misaligned or wrinkled, thus resulting in the transfer of a slanted or distorted indicia onto the belt. In addition, there was also the danger of the operator's hand becoming caught between the thermal roller and the belt, creating a safety problem as well. Furthermore, because the manually inserted marking paper fell onto the floor after passing between the thermal roller and the belt, the used marking paper had to be recovered, and this recovery involved further labor.

SUMMARY OF THE INVENTION

In consideration of the problems described above, it is a primary objective of this invention to provide a thermal transfer device for belt markings in which, by simply positioning the endless belt and the marking paper, in addition to the marking paper being automatically inserted between the thermal roller and the belt in perfect alignment therewith and with no wrinkles, the marking paper is easily recovered after the thermal transfer, and the operator can perform other tasks away from the thermal transfer machine during the thermal transfer operation, thus achieving a high level of work efficiency.

To achieve the foregoing, a thermal transfer machine in accordance with this invention is provided having a freely revolving belt attachment roller onto which an endless belt can be removably attached with the surface to be imprinted facing outwardly. A freely revolving thermal roller is mounted so as to be freely movable toward and away from the belt attachment roller, and a pair of support arms are placed parallel to each other across an open space so that the thermal roller is positioned between them. A marking paper support is provided which has securing fixtures for stretching the marking paper across the space between the support arms and which is capable of moving freely in a reciprocating motion in the front-to-back direction of the thermal roller. With the thermal roller pressed against the belt on the belt attachment roller by a pressing apparatus, the marking paper support is moved at the same speed as the peripheral velocity of the thermal roller in the direction of the tangent of the thermal roller occurring at the contact surface between the thermal roller and the belt, by a drive apparatus which turns the thermal roller.

In addition, it is preferable to use an oscillating motor having a reciprocating rotation action within a prescribed angle for the aforementioned drive apparatus, and to use the oscillating motor both for the reciprocating revolution of the thermal roller, and also for the reciprocating movement of the marking paper support in synchronization with the revolution of the thermal roller.

With the thermal transfer machine of this invention having the construction described above, the operator first attaches the endless belt onto the belt attachment roller with the surface to be imprinted facing outwardly, and then stretches the marking paper between the securing fixtures on the two support arms of the marking paper support. When the thermal transfer device is then operated, the thermal roller moves close to the belt on the belt attachment roller, and the marking paper support also moves close to the belt attachment roller together with the thermal roller. Then, when the thermal roller comes in contact with the belt, it is pressed against the belt at a fixed pressure. At this time, the marking paper support is positioned on the tangent occurring at the contact surface between the thermal roller and the belt. Next, the thermal roller is driven by the drive apparatus and begins to revolve in the specified direction, and the belt also begins to revolve together with the belt attachment roller. At the same time, the marking paper support moves at the same speed as the peripheral velocity of the thermal roller, the marking paper is inserted between the contact surfaces of the thermal roller and the belt and passes through in that same tangential direction, and the indicia on the marking paper is thermally transferred onto the surface of the belt to be imprinted. When the thermal transfer has been completed, the rotation of the thermal roller stops and the movement of the marking paper support also stops simultaneously, and then the thermal roller, together with the marking paper support, separates from the belt on the belt attachment roller. Next, the operator simply removes the belt from the belt attachment roller and also removes the marking paper from the marking paper support. Thus, once the operator has positioned the belt and the marking paper prior to the beginning of the thermal transfer process, it is then possible to leave the thermal transfer device and perform other work tasks.

In addition, with the thermal transfer device described herein, after the indicia on the marking paper is thermally transferred onto the belt, the oscillating motor will revolve for the prescribed angle in the opposite direction, and, in addition to the thermal roller revolving back to its original starting position, the marking paper support will return to its original starting position, and then the revolution of the thermal roller and the movement of the marking paper support will stop. Thus, at the completion of the thermal transfer operation, the removal and remounting of the marking papers on the marking paper support is greatly facilitated for the start of the next thermal transfer operation.

BRIEF DESCRIPTION OF THE DRAWINGS

The invention will be better understood from the following detailed description taken in conjunction with the accompanying figures of the drawings, wherein.

DETAILED DESCRIPTION OF THE DRAWINGS

Figure 1:
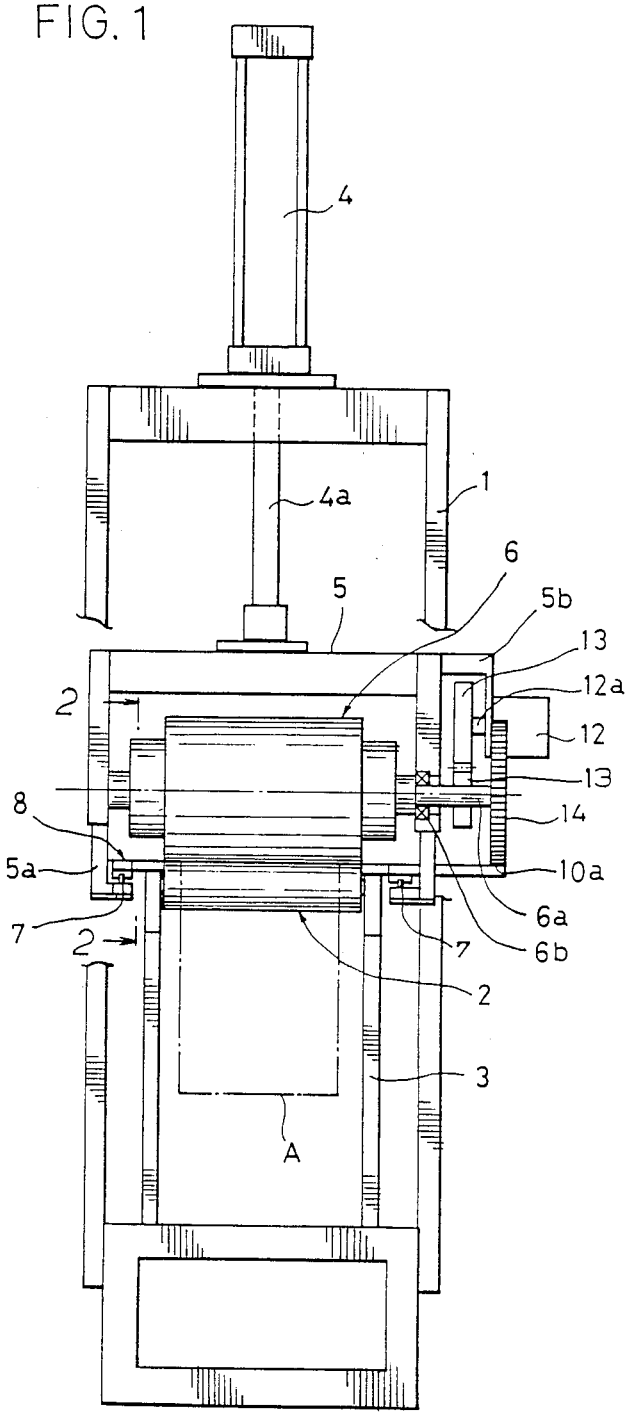
FIG. 1 shows a front view of a preferred embodiment of a thermal transfer machine according to this invention.
Figure 2:
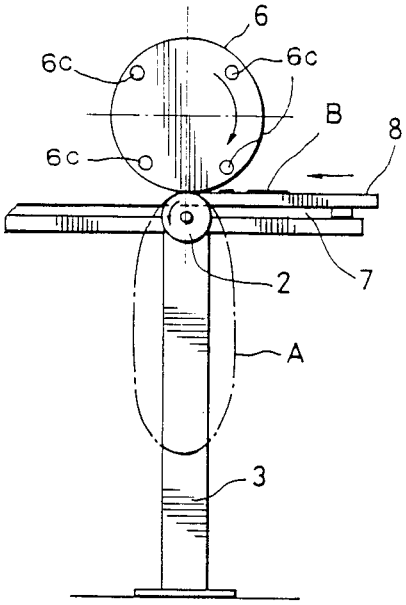
FIG. 2 is a fragmentary view along the line 2—2 of FIG. 1.
Figure 3:
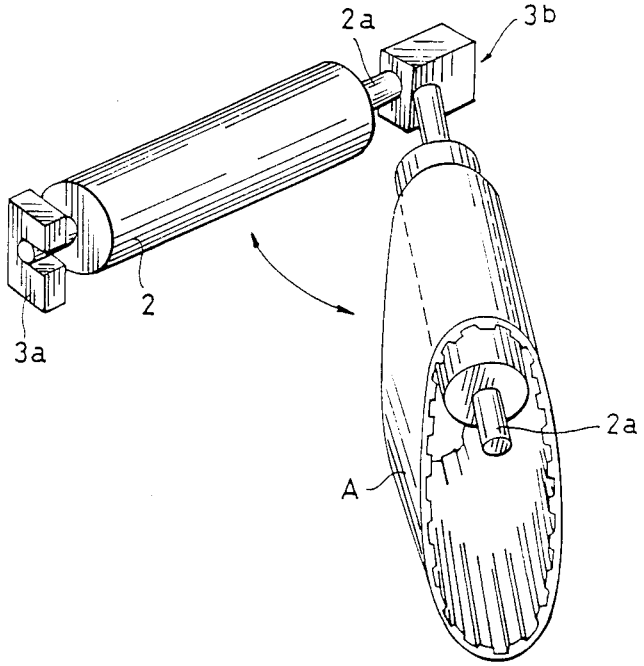
FIG. 3 shows a perspective view of a belt attachment roller of the machine.

FIGS. 1 and 2 show a belt attachment roller 2 positioned in approximately the center of a support frame 1. A pair of spaced apart upright support stays 3 are included in the frame 1, and the roller 2 is freely rotatably supported between the upper ends of the stays 3. With reference to FIG. 3, the belt attachment roller 2 is supported so as to be freely rotatable on a support shaft 2*a*, and one end of the support shaft 2*a* is supported by a member 3*b* at the upper end of one of the support stays 3 such that the shaft 2*a* may be swung in a horizontal plane. In addition, the other or free end of the support shaft 2*a* is mounted so that it may be engaged and disengaged by a C-shaped locking member 3*a* which is attached to the upper end of the other support stay 3, thus making it possible to open the free end of the belt attachment roller 2 when attaching a tube-shaped belt material A to the belt attachment roller 2. Note that a different arrangement may be provided if the belt material A is constructed such that it can be attached to the belt attachment roller 2 by insertion above the roller. It is also possible, for example, to use a construction wherein both ends of the support shaft 2*a* of the belt attachment roller 2 can be removed from the upper ends (the parts 3*a* and 3*b*) of the support stays 3.

A pneumatic cylinder 4 for use as the pressure application mechanism is mounted facing downwardly at the center of the top of the support frame 1, and the cylinder rod 4*a* is able to extend and retract downwardly through the frame 1. A support yoke 5 which opens downwardly is suspended from the lower end of the cylinder rod 4*a*. The support shaft 6*a* of a thermal roller 6 is mounted so as to be freely rotatable via bearings 6*b* between the shaft and the lower ends of the support yoke 5, and the thermal roller 6 is constructed so that it is parallel to and faces the belt attachment roller 2 and is raised and lowered by the pneumatic cylinder 4. Inside the thermal roller 6, multiple rod-shaped electric heaters 6*c* are installed along the outer surface of the roller 6 at uniform intervals, and the temperature can be regulated preferably within a range of 100° to 250° C.

An auxiliary yoke 5*a* extends downwardly from the lower ends of the support yoke 5, and a pair of guide rails 7 (FIGS. 1, 2 and 4) are individually mounted to this auxiliary yoke 5*a* in the front-to-back direction on each side of the lower part of the thermal roller 6 so as to be parallel to each other.

Figure 4:
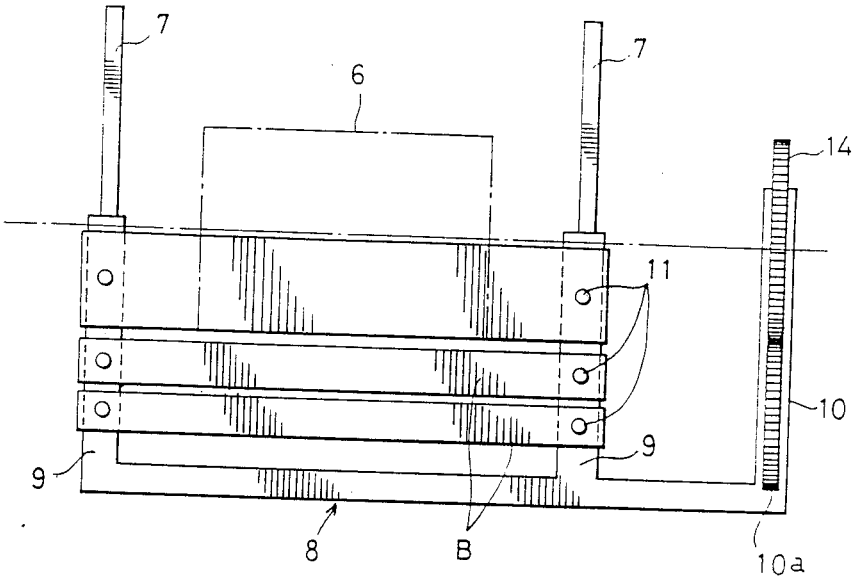
FIG. 4 shows a plan view of a marking paper support of the machine.

As shown in FIG. 4, a frame-shaped marking paper support 8 open to the front is mounted on the guide rails 7 so as to be freely movable in the forward and backward directions. This marking paper support 8 is provided with a pair of support arms 9 extending along the guide rails 7 and, parallel to these support arms 9, a rack arm 10 on the upper surface of which is formed a rack 10*a*. In addition, multiple (three in this embodiment) marking paper securing fixtures 11 are mounted onto each of the support arms 9 in the lengthwise direction with a space between each fixture. For these securing fixtures 11, it is possible to use pin-like fixtures such as those shown in FIG. 4, onto which holes cut in the marking paper B are fit, or clip-like fixtures such as those shown in FIG. 5, into which the marking paper B is inserted, as long as they are of such a construction as to allow the marking paper B to be stretched between the support arms 9 and secured so as to be freely attachable and detachable.

As shown in FIG. 1, the same hydraulic oscillating motor 12 is used for both the rotation of the thermal roller 6 and the movement (feed) of the marking paper support 8. Because this motor 12 moves in a reciprocating rotation back and forth within a prescribed angle (for example, 120°), there is no need to use limit switches or other control means to determine the rotational range for the reciprocating rotation of the motor. The oscillating motor 12 is mounted to the upper part of one side of the support yoke 5 via a support fixture 5*b*. In addition, the drive shaft 12*a* of the oscillating motor 12 and the support shaft 6*a* of the thermal roller 6 are connected via a speed-reducing gear 13, so that oscillating motor 12 drives the thermal roller 6 in reciprocating revolutions. Furthermore, a pinion 14 is mounted on one end of the support shaft 6*a* so as to be able to revolve as one unit, and this pinion 14 is meshed with the rack 10*a*. Thus, when the thermal roller 6 revolves, that revolution is converted into linear motion by the pinion 14 and the rack 10*a* so that the marking paper support 8 simultaneously moves along the guide rails 7. In addition, in order for the speed of travel of the marking paper support 8 to be equivalent to the peripheral velocity of the thermal roller 6, although in this embodiment the same dimensions are selected for the diameter of the pinion 14 and the diameter of the thermal roller 6, it is also possible to install a speed-increasing gear (not shown in the drawings) between the support shaft 6*a* and the pinion 14 and use a smaller diameter for the pinion 14 than that shown in the drawing.

The following is an explanation of the operation of the thermal transfer device according to the embodiment described above.

Figure 5:
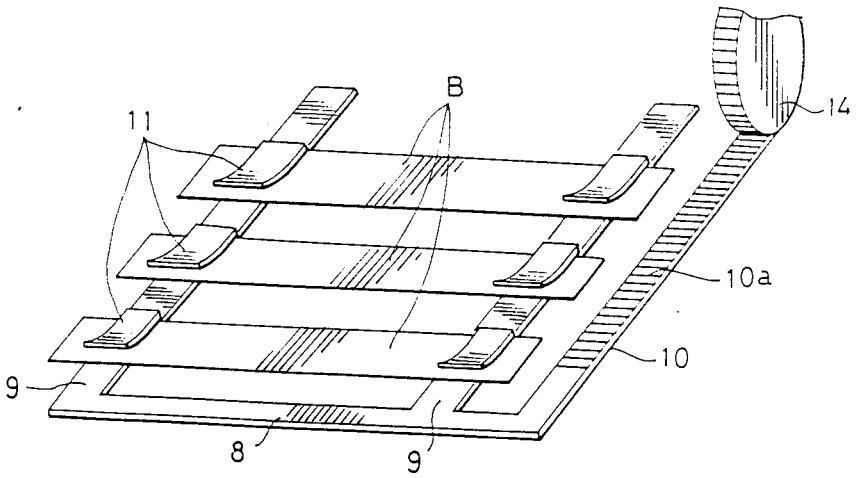
FIG. 5 shows a perspective view of another embodiment of the marking paper support.
Figure 6:
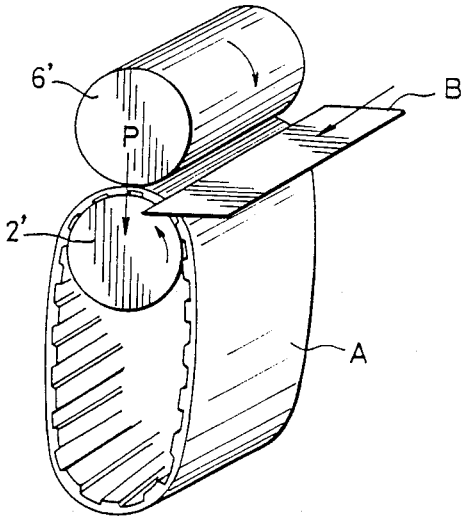
FIG. 6 PRIOR ART
FIG. 6 shows a perspective view of a thermal transfer device according to the prior art.

In FIG. 1, at the start of work, the thermal roller 6 and the marking paper support 8 are positioned slightly above the belt attachment roller 2 by retracting the rod 4*a*. The operator swings open one end of the support shaft 2*a* of the belt attachment roller 2 from the part 3*a*, places the tube-shaped belt material A onto the belt attachment roller 2 from the open end with the surface to be imprinted facing outwardly, as shown in FIG. 3, and then swings the end of the support shaft 2*a* of the belt attachment roller 2 closed and secures it in the locking member 3*a*. In addition, the operator also stretches multiple sheets of marking paper B between the securing fixtures 11 on the two support arms 9 of the marking paper support 8, as shown in FIGS. 4 or 5.

When the operator then operates the thermal transfer device, the remainder of the thermal transfer process is performed automatically in the following manner.

The cylinder rod 4*a* of the pneumatic cylinder 4 extends downwardly and the thermal roller 6 descends and moves close to the belt material A on the belt attachment roller 2, and, simultaneously, the marking paper support 8 also descends and moves close to the thermal roller 6. Then, when the thermal roller 6 comes in contact with the belt material A, a fixed pressure is applied to the belt material A by the pneumatic cylinder 4, and that pressure is maintained. In addition, in this state, the marking paper support 8 is positioned on the tangent occurring at the contact surface of the belt material A and the thermal roller 6. Next, the oscillating motor 12 begins to rotate, the thermal roller 6 begins to revolve in the clockwise direction as indicated in FIG. 2, and the belt material A on the belt attachment roller 2 also revolves together with the roller 2. Simultaneously, the pinion 14 revolves in accompaniment to the revolution of the thermal roller 6, and the marking paper support 8 is moved via the rack 10*a* forward (to the left in FIG. 2) on the guide rails 7 at the same speed as the peripheral velocity of the thermal roller 6. In this way, the multiple sheets of marking paper B mounted on the marking paper support 8 are inserted one after another between the contact surface of the thermal roller 6 and the belt material A, and they pass through in that tangential direction. Then, as the multiple sheets B of marking paper pass between the thermal roller 6 and the belt material A, heat and pressure are applied by the thermal roller 6, and the indicia on the marking papers are thermally transferred one after another onto the belt material A. Then, when all of the indicia on the marking papers have been thermally transferred onto the belt material A, the oscillating motor 12 stops rotating, and the revolution of the thermal roller 6 and the movement of the marking paper support 8 stop. At approximately the same time, the cylinder rod 4*a* of the pneumatic cylinder 4 retracts upwardly, and the thermal roller 6 rises upwardly together with the marking paper support 8, thereby separating from the belt material A from the belt attachment roller 2. Next, the oscillating motor 12 begins to rotate in the reverse direction, the thermal roller 6 revolves in the reverse direction back to its original revolution starting position, and the marking paper support 8 also moves backward to return to its original operation starting position. In this state, the oscillating motor 12 stops, the rotation of the thermal roller 6 and the movement of the marking paper support 8 stop, and one cycle of the thermal transfer process is complete.

Thus, when the thermal transfer process described above is completed, in the reverse of the procedure described above, the operator simply removes the belt material A from the belt attachment roller 2 and removes the marking paper B from the marking paper support 8. Note that the belt material A, imprinted by thermal transfer, can now be cut to specified widths to process it into finished product endless belts (not shown in the drawings). In addition, wide belts, pre-cut belts (not shown in the drawings) can also be imprinted by thermal transfer.

Although in the embodiment described above an oscillating motor 12 is used to effect the rotation of the thermal roller 6 and the movement of the marking paper support 8 so that both the roller 6 and the support 8 revolve or move in a reciprocating action in synchronization each time the thermal transfer process is performed, it is also possible to have the thermal roller 6 and the marking paper support 8 revolve or move in one direction in the first work operation and then revolve or move back to their original positions in the second work operation. In addition, instead of the oscillating motor 12, it is also possible to use an electric motor capable of reciprocating rotation and then regulate the reciprocating rotation by means of limit switches. Furthermore, it is also possible for both the thermal roller 6 and the marking paper support 8 to move toward and away from the belt attachment roller 2 in a horizontal or diagonal direction.

As explained above, the thermal transfer device of this invention has the following advantages.

(1) Because the operator simply has to position the endless belt and the marking paper in order for the marking paper to be automatically inserted between the thermal roller and the belt so that the markings are thermally transferred onto the belt, the operator can in the meantime perform other tasks away from the thermal transfer device, thus achieving a high level of work efficiency. Moreover, because the indicia from multiple sheets of marking paper can be thermally transferred in perfect alignment and with no wrinkles simply by placing the marking papers between the securing fixtures of the marking paper support, the operation is simple and requires no special skills, and also, because there is no longer any danger of the operator's hand becoming caught between the thermal roller and the belt, the work can be performed with a high level of safety. Furthermore, the marking paper is easily recovered after the thermal transfer.

(2) With the thermal transfer device described herein, because an oscillating motor with a reciprocating rotation action within a prescribed angle is used for reciprocating drive of the thermal roller and the marking paper support, the marking paper support returns to its original position after completion of the thermal transfer operation, thus facilitating the removal and remounting of the marking papers on the marking paper support for the start of the next thermal transfer operation; it also eliminates the need for limit switches or other control means, resulting in a simple overall construction for the device and a reduction in production costs.

What is claimed is:

1. A thermal transfer machine for belt marking, comprising a belt attachment roller onto which an endless belt can be removably attached with the surface to be imprinted facing outwardly, means for rotatably mounting said belt attachment roller, a rotatable thermal roller mounted so as to be movable toward and away from said belt attachment roller, drive apparatus for turning said thermal roller, a pair of support arms mounted parallel to each other across an open space so that said thermal roller is positioned between them, and a marking paper support which has securing fixtures for stretching the marking paper across the space between said support arms and which is capable of moving freely in a reciprocating motion in the front-to-back direction of said thermal roller; a pressing apparatus, and, with said thermal roller pressed against the belt on said belt attachment roller by said pressing apparatus, said marking paper support is movable at the same speed as the peripheral velocity of said thermal roller in the direction of the tangent of said thermal roller occurring at the contact surface between said thermal roller and the belt by said drive apparatus which turns said thermal roller.

2. A thermal transfer machine for belt marking as described in claim 1, wherein an oscillating motor with a reciprocating rotation action within a prescribed angle is used for said drive apparatus, and, in addition to driving said thermal roller in reciprocating rotation, said oscillating motor also drives in a reciprocating movement of said marking paper support in synchronization with the rotation of said thermal roller.

* * * * *